United States Patent [19]

Lange

[11] Patent Number: 4,839,068

[45] Date of Patent: Jun. 13, 1989

[54] POLYSUCCINATE ESTERS AND LUBRICATING COMPOSITIONS COMPRISING SAME

[75] Inventor: Richard M. Lange, Euclid, Ohio

[73] Assignee: The Lubrizol Corporation, Wickliffe, Ohio

[21] Appl. No.: 199,223

[22] Filed: May 26, 1988

Related U.S. Application Data

[63] Continuation-in-part of Ser. No. 103,634, Oct. 1, 1987, abandoned.

[51] Int. Cl.[4] ..... C10M 145/22

[52] U.S. Cl. ..... 252/33.6; 252/34; 252/35; 252/38; 252/52 A; 252/51.5 R; 252/51.5 A; 252/56 D; 528/272; 528/297; 528/300

[58] Field of Search ..... 252/56 D; 528/272, 297, 528/300

[56] References Cited

U.S. PATENT DOCUMENTS

| | | | |
|---|---|---|---|
| 2,134,429 | 10/1938 | Brown | 528/300 |
| 2,497,432 | 2/1950 | Blake | 252/56 D |
| 3,045,042 | 7/1962 | Staker | 252/56 D |
| 3,291,736 | 12/1966 | Buehler et al. | 252/56 D |
| 3,427,255 | 2/1969 | Case | 528/272 |
| 3,708,522 | 1/1973 | Le Suer | 252/56 D |
| 3,843,535 | 10/1974 | Denis et al. | 252/56 D |
| 3,859,318 | 1/1975 | Le Suer | 252/56 D |
| 3,919,172 | 11/1975 | Rhein et al. | 528/272 |
| 4,124,571 | 11/1978 | Georgoudis | 528/300 |
| 4,317,740 | 3/1982 | Eisenhard | 252/56 D |
| 4,403,093 | 9/1983 | Hartman et al. | 528/297 |
| 4,447,595 | 5/1984 | Smith et al. | 528/300 |
| 4,480,087 | 10/1984 | Trotter et al. | 528/272 |
| 4,502,976 | 3/1985 | Heller | 528/300 |

*Primary Examiner*—William R. Dixon, Jr.
*Assistant Examiner*—Ellen M. McAvoy
*Attorney, Agent, or Firm*—Joseph P. Fischer; James L. Cordek; Robert A. Franks

[57] ABSTRACT

Polyesters containing hydrocarbon substituted succinic groups, including capped polyesters, and having molecular weights between about 1000 and about 4000 are additives for mineral oil based lubricating oils. These polyesters impart friction reducing and viscosity improving properties to the base oil and enhance film-forming properties of the oil.

39 Claims, No Drawings

POLYSUCCINATE ESTERS AND LUBRICATING COMPOSITIONS COMPRISING SAME

CROSS-REFERENCE TO RELATED APPLICATION

This application is a continuation-in-part of copending application Ser. No. 103,634, filed Oct. 1, 1987, now abandoned.

FIELD OF THE INVENTION

This invention relates to polyesters, and in particular to succinic group based polyesters. These polyesters find utility in lubricants as friction reducers and as viscosity improvers, and enhance film-forming properties of base oils.

BACKGROUND OF THE INVENTION

In the operation of modern internal combustion engines, it is desirable, and often necessary because of government regulation, to obtain maximum fuel economy. From a purely economic standpoint, with the increasing cost and, from time to time, shortages of hydrocarbon fuels, improving the fuel efficiency of internal combustion engines is very desirable. Accordingly, methods for improving fuel economy have been the subject of numerous U.S. Pat. Nos., including U.S. Pat. No. 4,584,115, 4,237,022, and U.S. Pat. No. 4,406,802.

Many polymeric materials have been developed for use as viscosity improvers. The purpose of viscosity improvers is to minimize the changes in viscosity of an oil composition when it is exposed to a variety of temperatures. Included among viscosity improvers known in the art are polyolefins, styrene-butadiene copolymers, high molecular weight polyesters, and the like. Examples of such products appear in U.S. Pat. No. 2,394,909, U.S. Pat. No. 3,598,738, U.S. Pat. No. 3,772,169, and U.S. Pat. No. 3,795,616.

Recently, efforts have been directed toward preparing additives for lubricants and fuels which have multifunctional properties. The advantages of such multifunctional additives are obvious. For example, it is often less costly to prepare a single additive having multifunctional characteristics, rather than preparing several additives, each having a single characteristic. When such multifunctional additives are available, it is not necessary to have a multitude of storage tanks to store a variety of additives for blending. Storage space requirements and shipping costs are often reduced when the multifunctional additive provides, on a reduced weight basis, the same performance as two or more additives which each provide a single function. Examples of well-known multifunctional additives are dispersant-viscosity improvers, basic metal salts which have antioxidant properties, and the like.

Certain polysuccinate esters are known. U.S. Pat. No. 2,993,773 describes numerous esters of alkenyl succinic acids and anhydrides, and the use thereof as deposit modifiers in fuels. Mixed esters of polyhydric alcohols and the use thereof as synthetic oils are described in U.S. Pat. No. 2,575,196. U.S. Pat. No. 2,134,736 refers to mono and polyhydric alcohol esters of polybasic carboxylic acids as additives for lubricating oils. There is no suggestion of polyesters. U.S. Pat. No. 2,394,909 refers to polyesters having average molecular weights between 5000 and 25,000 as viscosity improvers for lubricants. U.S. Pat. No. 2,561,232 describes diesters derived from dibasic acids and monohydric alcohols. U.S. Pat. No. 2,570,037 relates to diesters derived from dibasic acids and ether-alcohols. U.S. Pat. No. 2,929,786 describes synthetic lubricating oil compositions wherein a reaction product of a dibasic acid and a glycol is employed as the synthetic lubricant or as an additive for a synthetic lubricant. U.S. Pat. No. 3,381,022 describes polyesters which have a high molecular weight substituent on the succinic group. U.S. Pat. No. 4,209,411 describes polyesters derived from a hydrocarbon substituted succinic anhydride and a cyclic poly(-methylol) compound.

SUMMARY OF THE INVENTION

It is an object of this invention to provide additives for lubricants which provide improved frictional characteristics and which, when used in lubricating oils, provide fuel economy improving benefits. It is a further object to provide lubricants which impart improved fuel economy benefits. It is a further object to provide additives which improve the viscosity characteristics of lubricating oils. It is another object to provide lubricants having improved viscosity properties. Another object of this invention is to provide additives for lubricants, which additives have multifunctional characteristics. Other objects will be apparent upon reading the specification and claims of this invention.

It has now been discovered that lubricating compositions comprising a major amount of a mineral oil of lubricating viscosity and at least one polysuccinate ester having a molecular weight between about 1000 and about 4000, and wherein the succinic groups contain alkyl or alkenyl substituents each having from about 4 to about 28 carbon atoms, provide viscosity improving and friction reducing properties to the lubricating oil. The above-described polyesters are preferably prepared by the condensation reaction of (A) at least one alkyl or alkenyl substituted succinic acid or anhydride, wherein the alkyl or alkenyl substituent contains from about 4 to about 28 carbon atoms with (B) at least one open-chain aliphatic compound having at least two OH groups, wherein the ratio of reactant A to B is from about 1 succinic group:1.8 OH groups to about 1 succinic group:4 OH groups.

An alternative means for preparing polyesters useful in the lubricating compositions of this invention comprises the condensation reaction of component (A) with (C), at least one epoxide.

This invention also relates to a polysuccinate ester of the formula $$A-S-E-(S-E)_n-S-B \qquad \text{(II)}$$

wherein n is a number between 1 and about 8, each S is a group of the formula

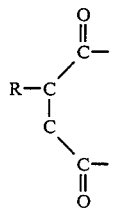

(III)

wherein

R is an alkyl or alkenyl group having from 4 to about 28 carbon atoms, and each E is a group of the formula $$-O(R'O)_a \quad \text{(IV)}$$

wherein

R′ is selected from the group consisting of alkylene groups having from 2 to about 28 carbon atoms, hydroxy substituted alkylene groups having from 2 to about 28 carbons, and containing from one to about 6 hydroxy groups, with the proviso that the number of hydroxy groups does not exceed the unsatisfied valences of R′, and succinate ester substituted alkylene groups, and wherein a is a number ranging from 1 to about 8, wherein each A and each B is independently

—OH,

—$OR^2$, wherein $R^2$ is an alkyl group containing from 1 to about 28 carbons,

—$O(R'O)_bH$, wherein R′ is an alkylene group containing from about 2 to about 28 carbon atoms, and b is a number ranging from 1 to about 8, and —$NR_2^3$, wherein each $R^3$ is independently H or an alkyl group having from 1 to about 18 carbon atoms, with the proviso that at least one of A or B is not —OH, or, when A or B is —OH, that is, when the terminal group contains a carboxylic acid group, a salt may be formed by reaction with a basic metal containing reagent, ammonia or an amine, and which polysuccinate ester has a molecular weight between about 1000 and about 4000, and lubricating oil compositions comprising a major amount of a mineral oil of lubricating viscosity and a minor amount of the polysuccinate ester of formula (II).

Methods for improving fuel economy employing the lubricating compositions of this invention are described.

DETAILED DESCRIPTION OF THE INVENTION

The lubricating oil compositions comprise polysuccinate esters having a molecular weight between about 1000 and about 4000, and wherein the succinic groups within the polymer have alkyl or alkenyl substituents each having from about 4 to about 28 carbon atoms.

The expression "polyester" is broadly defined in the art as a material containing a plurality of ester groups. Thus, a compound of the formula

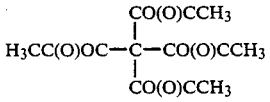

(I)

could be considered a polyester. In the context of this invention, the expression polyester is intended to encompass only those materials which are polymeric polyesters. That is, the polysuccinate esters of this invention are polymers containing multiple ester linkages, and have the general formula $$A—S—E\text{-}(S—E)_n\text{-}S—B \quad \text{(II)}$$

wherein n is a number between 1 and about 8, each S is a group of the formula

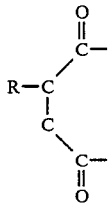

(III)

wherein

R is an alkyl or alkenyl group having from 4 to about 28 carbon atoms, and each E is a group of the formula $$-O(R'O)_a \quad \text{(IV)}$$

wherein

R′ is selected from the group consisting of alkylene groups having from 2 to about 28 carbon atoms, preferably those having 2 or 3 carbon atoms, hydroxy substituted alkylene groups having from 2 to about 28 carbons, and containing from one to about 6 hydroxy groups, with the proviso that the number of hydroxy groups does not exceed the unsatisfied valences of R′, and succinate ester substituted alkylene groups, and wherein a is a number ranging from 1 to about 8, preferably 1 or 2, and each A and each B is independently

—OH,

—$OR^2$, wherein $R^2$ is an alkyl group containing from 1 to about 28 carbons,

—$O(R'O)_bH$, wherein R′ is an alkylene group containing from about 2 to about 28 carbon atoms, more often 2 or 3 carbons, and b is a number ranging from 1 to about 8, preferably 1 or 2, and —$NR_2^3$, wherein each $R^3$ is independently H or an alkyl group having from 1 to about 18 carbon atoms, with the proviso that at least one of A or B is not —OH, or, when A or B is —OH, that is, when the terminal group contains a carboxylic acid group, a salt may be formed by reaction with a basic metal containing reagent, ammonia or an amine, preferred metals being sodium, potassium, calcium, zinc and copper, and which polysuccinate ester has a molecular weight between about 1000 and about 4000.

Thus, the polysuccinate ester may contain other polyester branches, including other polysuccinate ester branches, but the main polyester chain must have the polymeric polyester structure described hereinabove.

The polysuccinate esters may be prepared in a variety of ways. One method is to react an epoxide with an alkyl or alkenyl substituted succinic anhydride at a temperature between about 125° to 225° C., preferably between about 140 to about 170° C., usually in the presence of a tertiary amine catalyst. A general procedure is set forth in U.S. Pat. No. 3,381,022, which is hereby expressly incorporated herein by reference. Other procedures for preparing polysuccinate esters are likewise described in this patent.

The polysuccinate esters of this invention preferably contain a minimal number of unreacted carboxylic groups. The amount of unreacted carboxylic acid remaining can be determined by measuring the acid number of the polysuccinate ester employing the method described in American Society for Testing and Materials D-974, which method is expressly incorporated herein by reference. Although it is generally preferred to minimize the unreacted carboxylic acid remaining in the polyesters, it is not always critical, and it is sometimes advantageous, if the polyester contains some unreacted carboxylic acid. Accordingly, depending on the extent of reaction, whether the unreacted carboxylic acid groups have been further reacted to "cap" the polyester, and also, on the molecular weight of the polymer, the acid number may range between 0, that is, free of carboxylic acid, to about 60.

The acid number of the polysuccinate ester depends on several factors including the size of the substituents on the succinic groups, the extent of polymerization and the number of carboxylic acid groups present on the polysuccinate ester. Preferably, the polysuccinate ester has at least 50% of the possible terminal carboxylic acid groups converted to ester groups, amido groups, salts or mixtures thereof. Polysuccinate esters having acid numbers up to about 30, preferably between about 10 and about 20 are often useful additives for the lubricating oil compositions of this invention.

As mentioned hereinabove, the polysuccinate esters employed in the lubricating oils of this invention have a molecular weight between about 1000 and about 4000. Preferably, the polysuccinate esters have molecular weights between about 1500 and about 4000, often between about 1500 and about 3000, and frequently between about 2000 and about 3000.

It has been found that polyesters having molecular weights between about 1000 and about 4000 have exceptional stability towards mechanical shear, which permits these polymers to be employed in lubricating oils subjected to high shear conditions, such as in lubricants for gear oils and modern internal combustion engines.

Methods for determining molecular weights of polymers are well known in the art. Such methods include gel permeation chromatography, boiling point elevation, vapor phase osmometry and others. Textbooks on general polymer chemistry, including "Macromolecules, An Introduction to Polymer Science", F. A. Bovey and F. H. Winslow, Editors, Academic Press, New York (1979), pages 296–316, and P. J. Flory, "Principles of Polymer Chemistry", Cornell University Press (1953) Chapter VII, pages 266–316, describe these methods. It has been found that vapor phase osmometry (VPO) is a particularly useful method for determining number average molecular weights of the polysuccinate esters of this invention.

Gel permeation chromatography is an effective tool for measuring molecular weights, particularly when the instrument is calibrated against known compounds of similar structure and molecular weight.

The substituent on the succinic group of the polysuccinate esters may contain from about 4 to about 28 carbon atoms. When it is desired that the polymer of this invention provide fuel economy improving benefits, it is usually desirable that the alkyl or alkenyl group contain at least about 8, and preferably at least about 12 carbon atoms. Particularly desirable polyesters for use as fuel economy improving and friction reducing additives will have at least one substituent containing from about 12 to about 24 carbons, more often from about 14 to about 18 carbons. The substituent on the succinic group may be linear or branched chain. When it is desired to use the polymer as a friction reducer, it has been found that a substituent comprising a straight chain segment containing at least about 8 carbon atoms, more preferably about 12 carbon atoms is desirable. These substituents correspond to the group R in formula (II).

The polysuccinate esters are preferably glycol esters, glycerol esters, pentaerythritol esters or neo-diol esters. Ne-diol esters are particularly stable.

The polysuccinate esters are preferably derived from alkyl or alkenyl substituted succinic acids or anhydrides which have been reacted with certain polyhydric alcohols and which may then be further reacted with an additional reagent reactive with carboxylic acids to "cap" the polymer by reacting with any remaining carboxylic acid groups The polysuccinate esters (A) of this invention are preferably derived from substituted succinic acids of the formula

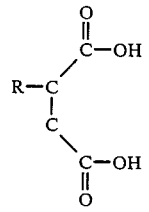

or substituted succinic anhydrides of the formula

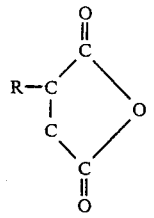

wherein R is an alkyl or alkenyl group containing from 4 to about 28 carbon atoms. The alkyl or alkenyl groups themselves may contain other substituents which do not significantly alter the essentially alkyl or alkenyl character of the group. Such substituents include, but are not necessarily limited to, halogen, such as chlorine, alkoxy, such as methoxy, and the like. Preferably there will be no more than one such substituent for every 10 carbon atoms of alkyl or alkenyl substituent. Most preferred is when the alkyl or alkenyl substituents are purely hydrocarbyl, that is, no more than an impurity amount of atoms other than carbon or hydrogen are present in the alkyl or alkenyl group.

The substituted succinic acids or anhydrides employed in the process of this invention are prepared by methods well known to those skilled in the chemical arts. Several methods are given in U.S. Pat. No. 2,993,773 and U.S. Pat. No. 2,394,909, which are hereby incorporated by reference. A preferred method involves reaction of maleic anhydride with a monoolefinic monomer or oligomer at 100°–200° C. with or without a catalyst to form the corresponding substituted succinic anhydride. The succinic anhydride can be hydrolyzed by heating with water to form the corresponding succinic acid.

Although the source of the alkyl or alkenyl based substituent is not a critical aspect of this invention, this substituent will generally be derived from various olefinic monomers such as ethylene, propylene, butylene, hexene, octene, decene, etc, including the oligomers, prepolymers and low molecular weight polymers formed from the foregoing monomers. Thus, dimers, trimers and/or tetramers of propylene and butylene can be used.

As mentioned hereinabove, the polysuccinate esters used in the lubricating oils of this invention can be prepared by various reactions with succinic acids or anhydrides. One of the mentioned reactions involves the condensation of a succinic anhydride as described hereinabove with an epoxide. Particularly useful epoxides for this reaction are those derived from alpha-olefins. Improved frictional properties are obtainable when the alpha-olefin epoxide contains a straight-chain segment of at least about 8 carbons, preferably at least about 12 carbons, and up to about 28 carbons. Epoxides having straight-chain segments containing from about 12 to about 24 carbon atoms, more often from 14 to 18 carbons, are especially preferred. Particularly preferred is when the straight-chain segment is an alkyl or alkenyl group.

In the method which is preferred because of convenience and superior properties of the esters obtained, the polyester is prepared by the condensation reaction of a suitable polyhydric alcohol with the substituted succinic acids or anhydrides described hereinabove.

The reaction between the succinic acid or anhydride and the polyhydric alcohol is normally conducted at a temperature from about 150° C. up to the lowest temperature at which one of the reactants undergoes significant decomposition. Preferably, the reaction is conducted at no more than about 250° C., more preferably between about 175° to about 225° C.

Depending on the size of the batch, the reaction may be conducted for a period of from 5–8 hours for a small laboratory batch of a few liters up to 24 hours or more for larger scale pilot plant or manufacturing batch. Also, the duration of reaction may be dictated by the desired molecular weight and acid number of the product. That is, to prepare a higher molecular weight polyester, or one having a relatively low acid number may require a longer reaction time than will a product with a low molecular weight or higher acid number. Prolonged heating beyond the time necessary to attain a product having the desired characteristics, besides being wasteful, also may result in further condensation of polymers in the reaction mixture which could result in formation of substantial amounts of polymers having molecular weights higher than desired.

It is often helpful to monitor the reaction to determine the molecular weight of the reaction product during the course of the reaction. This is generally accomplished by periodically withdrawing samples from the reaction mixture and measuring the molecular weight of the polyester contained therein. A particularly useful means for determining the molecular weight of the polyester in the reaction mixture is to employ gel permeation chromatography (GPC) or high-speed GPC. The instrument preferably is calibrated employing polyesters of the type and molecular weight range of the polyesters being analyzed. Other methods, such as vapor phase osmometry, while useful for determining the molecular weight of the polyester product, may be influenced by impurities, unreacted components, etc., present in a crude reaction mixture before workup.

The polyhydric alcohols useful in the preparation of the polysuccinate esters may contain up to about 8 hydroxyl groups, and may be linear or branched. For example, glycerol, containing 3 hydroxy groups is linear and pentaerythritol, with four hydroxyl groups, is branched. Neopentylene glycol, with 2 hydroxyl groups, is branched. Thus, the expressions "branched" or "linear" refer to the configuration of the hydrocarbon backbone of the polyhydric alcohol. Preferred polyhydric alcohols are ethylene glycol, neopentylene glycol, glycerol and pentaerythritol. Mixtures of polyhydric alcohols may be used. Diols usually result in essentially linear polysuccinate esters, whereas triols and higher polyhydric alcohols may result in the formation of branched polysuccinate esters. Also, tri- and higher polyhydric alcohols can provide polyesters containing hydroxyl groups. Ethylene glycol is an especially preferred polyhydric alcohol for preparing the polysuccinate esters used in the lubricating oils of this invention.

The polyhydric alcohols used in the preparation of the polysuccinate esters of this invention also may include polyethers or partial fatty acid esters of polyols. Useful polyethers include polyhydroxy polyalkoxy alkanes, such as diethylene glycol. Useful partial fatty acid esters will contain at least two hydroxyl groups. Glycerol monooleate is illustrative.

The polyhydric alcohol will generally contain from two to about 28 carbons. As mentioned hereinabove, one way of providing fuel economy benefits is to have substituents in the succinic group containing at least about 8 carbon atoms, preferably, a straight-chain segment containing at least about 8 carbon atoms. Improved frictional properties can also be obtained when the polyhydric alcohol contains a linear, terminal hydrocarbon segment containing at least about 8 carbon atoms, preferably at least about 12 carbon atoms. Polyesters providing friction modifying and fuel economy benefits often will contain from about 12 to about 24 carbon atoms, frequently from 14 to 18 carbon atoms in the terminal hydrocarbon segment described above. For example, a 1,2-alkane diol, such as 1,2-hexadecanediol, can be reacted with a succinic anhydride having hydrocarbon substituents containing 4 carbon atoms. The resulting polyester can be used as a fuel economy improving agent.

The polysuccinate esters of this invention may have acid numbers ranging between 0 and about 60. Thus, a certain number of carboxylic acid groups may remain unreacted. The extent of reaction of the substituted succinic acid or anhydride with the polyhydric alcohol and the formula weights of the reactants will influence the acid number of the resulting polyester. As discussed hereinbelow, the polyester may be further reacted with other reagents to further reduce the acid number.

It has been found that the stoichiometric ratio of reactants and the nature of the polyhydric alcohol are the most important factors in determining the molecular weight of the polyesters prepared therefrom. In order to minimize the number of unreacted carboxylic acid groups present in the polysuccinate esters used in the lubricating oil compositions of this invention, the stoichiometric ratio of succinic acid (or anhydride) to equivalents of hydroxyl groups available on the polyhydric alcohol must be considered. It has been found that at least 1.8 OH groups should be reacted with each succinic group, which contains two potentially reactive carboxylic groups. Depending on other considerations, such as steric hindrance of the polyhydric alcohol, a greater ratio of available OH groups may be present in the reaction mixture for each succinic group. When the polyhydric alcohol is a diol, it is preferred to employ the reactants in a ratio in the range of from about 1.8 to about 2.3 OH groups for each succinic group. For higher polyhydric alcohols, particularly sterically hindered polyhydric alcohols, a ratio in the range of from about 2.9 to about 4 OH groups per succinic group is often preferred. It is sometimes desirable, for example, when employing a volatile polyhydric alcohol, to employ an excess of polyhydric alcohol to compensate for loss of volatile reactant. Usually a ratio between about 1.8 and about 4 OH groups per succinic group will provide a satisfactory polysuccinate ester.

If it is desired to reduce the number of carboxylic acid groups present in the polysuccinate ester, the ester may be further reacted with other reagents reactive with carboxylic acids. Thus, the polysuccinate ester may be reacted with other reagents such as amines, basic metal compounds, alcohols and the like. This reaction is often referred to as "capping". Capping may take place by reaction of a polysuccinate ester which contains carboxylic acid groups, with a monohydric alcohol, a diol, a lower amine having at least one N—H group, an isocyanate, or a metal-containing reagent. When the "capping reagent" contains more than one site reactive with a carboxylic acid, care must be taken, such as minimizing reaction time, to avoid increasing the molecular weight of the polysuccinate ester which could take place if two carboxylic acid group containing polysuccinate ester compounds are further reacted with a single polyfunctional "capping reagent". Accordingly, it is preferred that the "capping reagent" is a monofunctional reagent such as a lower monohydric alcohol, an ethoxylated alcohol, a monoamine and the like. Illustrative examples include methanol, dibutylamine, N,N-diethyl ethanolamine and the like. When the capping reagent is an alcohol, catalysts such as those described elsewhere in this specification for use in similar reactions, may be used, and are usually preferred.

Although the polysuccinate esters useful in this invention can be prepared in the absence of catalysts, catalysts are often employed. Tertiary amines, especially lower alkyl tertiary amines (i.e., each alkyl has no more than seven carbons) are very useful catalysts for the condensation reaction of substituted succinic anhydrides with epoxides. Various metal-containing compounds serve as catalysts for esterification of a carboxylic acid moiety with an OH-containing reagent. Particularly useful catalysts are titanium alkoxides, aluminum alkoxides, and certain metal-containing bases including $Sb_2O_3$, $SnO_2$ and $PbO_3$ Catalysts such as sulfuric acid, pyridine hydrochloride, hydrochloric acid, benzene sulfonic acid, p-tolune sulfonic acid, phosphoric acid, or any other known esterification catalyst may be used. Other materials useful as catalysts will occur to the skilled worker. The amount of the catalyst in the esterification reaction may be as little as 0.01% by weight of the reaction mixture, more often from about 0.1% to about 5%.

If a polyester is found to have too low a molecular weight, one of the metal-containing catalysts, such as titanium isopropoxide, can be injected into the reaction mixture, together, if deemed appropriate, with additional polyhydric alcohol or anhydride (or diacid) to rebalance the carboxylic acid:OH ratio and induce coupling of the polyester to higher molecular weight products.

It is frequently useful if the polyester contains hydroxyl groups. The hydroxyl group moiety is a polar group which provides surface activity to the polyester. That is, the polyester is attracted at the polar hydroxyl groups to the metal being lubricated. Means for incorporating hydroxyl groups into the polyester include controlling reaction conditions such that a portion of the hydroxyl groups of the polyhydric alcohol reactant remains unreacted. Such means include charging a stoichiometric excess of polyhydric alcohol reactant relative to succinic reactant, controlling the extent of reaction, e.g., by limiting reaction duration, operating at lower temperatures, and the like.

The following examples illustrate several intermediates and polysuccinate esters prepared therefrom. These examples are presented for illustrative purposes only, and are not intended to be considered as limiting the scope of this invention. Unless indicated otherwise, temperatures are in degrees Celsius and pressures are in Torr.

EXAMPLE 1

To a reaction vessel containing 1896 parts of maleic anhydride is added 4446 parts of a commercial mixture of $C_{15-18}$ predominantly straight-chain alpha-olefins. The mixture is heated to reflux under nitrogen, and the temperature is allowed to increase to 210° C. over 16 hours. The material is stripped to 210° C. at 10 Torr to remove volatiles and the residue is filtered with a diatomaceous earth filter aid. The filtrate is the desired substituted succinic anhydride.

EXAMPLE 2

Following substantially the procedure of Example 1, a commercial mixture of $C_{18-24}$ olefins, comprising predominantly vinyl and vinylidene group-containing alpha-olefins, is reacted with maleic anhydride.

EXAMPLE 3

To a one-liter, four-necked flask equipped with a stirrer, thermowell, a sub-surface nitrogen sparge tube and a Dean-Stark water trap with a reflux condenser, is charged 303 parts of a reaction product prepared according to the procedure of Example 1, and 68 parts of ethylene glycol. The mixture is heated to 151° C. over two hours with a sub-surface nitrogen sparge, until water evolution begins. Water is collected in the Dean-Stark trap. Heating is continued for a total of 24 hours while the temperature increases to 176° C. and water is collected. Water evolution is essentially complete after about 9–10 hours, but the acid number as determined by ASTM-D974 continues to decrease until the residue has an acid number of about 17. The reaction mixture is stripped to 170° C. at 7 Torr, and the viscous residue is filtered through a diatomaceous earth filter aid at 150° C.

EXAMPLE 4

Following essentially the same procedure as Example 3, 414 parts of a substituted succinic anhydride prepared essentially according to the procedure of Example 2 is reacted with 68 parts of ethylene glycol. The product has an acid number as measured by ASTM-D974 of about 15.

EXAMPLE 5

A two-liter, four-necked flask equipped with a stirrer, thermowell, a Dean-Stark water trap with reflux condenser is charged with 447 parts of a succinic anhydride prepared essentially according to the procedure of Example 2. 95 parts 2-butyne-1,4,diol are added, and the materials are heated to melting. The reaction is run at 120° C. (reflux) for two hours, while collecting 5 milliliters water in the Dean-Stark tube. While stirring, 4 parts tetraisopropyltitanate is added followed by heating at 200° C. for 7 hours. The materials are stripped to 120° C. at 18 Torr, then filtered through a diatomaceous filter aid.

EXAMPLE 6

A 2-liter, 4-necked reactor equipped with a nitrogen sparge tube, mechanical stirrer, thermowell and reflux condenser is charged with 360 parts of a commercial $C_{16}$ alpha-olefin epoxide, 672 parts of a succinic anhydride prepared essentially according to the procedure of Example 2, and 7.5 parts tributyl amine. The mixture is heated to 125° C. and held for 1 hour. The temperature is raised to 150° C. and held at 150°-155° C. for 4 hours. The temperature is increased to 179° C. for 5 hours after an additional 7.5 parts tributyl amine is added. 18 parts additional epoxide is added and the reaction mixture is stirred at 150°-155° C. for one hour. The infrared spectrum indicates residual anhydride. Additional 18 parts epoxide is added and the reaction is continued at 150°-155° C. for 1.5 hours. A nitrogen sparge is continued throughout the reaction. The reaction mixture is then filtered through a diatomaceous filter aid. The product has a number average molecular weight as measured by vapor phase osmometry of 1075.

EXAMPLE 7

330 parts of a polyester prepared according to the procedure of Example 3 is reacted with 4 parts of $CH_3OH$ in the presence of tetraisopropyl titanate catalyst at 155° C. for 3 hours.

EXAMPLE 8

330 parts of a polyester prepared according to the procedure of Example 3 is reacted with 7 parts of di(n-butyl)amine and vacuum stripped to remove unreacted amine.

EXAMPLE 9

425 parts of a polyester prepared according to the procedure of Example 4 is reacted at room temperature with 18 parts of t-$C_{12-14}$ primary amine (Primene 81R—Rohm and Haas).

EXAMPLE 10

425 parts of a polyester prepared according to the procedure of Example 4 is reacted with 6 parts of ethylene glycol at 150° C. for 0.5 hours.

EXAMPLE 11

A 3-liter, 4-necked flask equipped with a stirrer, thermowell, a nitrogen sparge and a Dean-Stark water trap with a reflux condenser is charged with 303 parts of the substituted succinic anhydride of Example 1 and 90 parts of ethylene glycol. The reaction mixture is heated to 150° C. and held at 150°-158° C. over 18 hours. Water (7.9 ml) is removed. 142 parts of stearic acid is charged to the flask over 0.1 hours and is heated to 160° C. over 16 hours while collecting an additional 4.8 ml $H_2O$. The product is stripped to 180° C. at 10 Torr followed by filtration through cloth and diatomaceous earth at 150° C. The product has a number average molecular weight as determined by gel permeation chromatography of 1790.

EXAMPLE 12

A 1-liter flask equipped in the same fashion as that of Example 11 is charged with 227 part of the succinic anhydride of Example 1, 106 parts of that of Example 2 and 96 parts of ethylene glycol. The reaction is conducted at 150°-168° C. over 14 hours while collecting 6.8 ml $H_2O$. 142 parts stearic acid is charged and the temperature is increased to 180° C. over 2 hours and held at 180°-188° C. over 5 hours while collecting 6.8 ml $H_2O$. The mixture is stripped to 180° C. at 15 Torr and the residue is filtered as in Example 11. The product has a number average molecular weight by gel permeation chromatography of 1610.

EXAMPLE 13

Following essentially the procedure of Example 6, 240 parts of $C_{16}$alpha-olefin epoxide and 265 parts of n-dodecenyl succinic anhydride are reacted in the presence of 5 parts of tributylamine. The product obtained has a number average molecular weight of 1754, determined by vapor phase osmometry.

EXAMPLE 14

A 500 milliliter flask is equipped with a stirrer, Dry Ice-isopropanol condenser and gas inlet tube, is charged with 250 parts of the product of Example 13 and is heated to 110° C. Ethylene oxide is passed into the reactor contents at 0.2 moles/hour over 2.5 hours, at 110°-115° C. The polyester product has an acid number (ASTM D-974) of 3.8.

EXAMPLE 15

A 1-liter flask equipped with a stirrer, thermowell, $N_2$ sparge and Dean-Stark trap with condenser is charged with 303 parts of the succinic anhydride of Example 1 and 148 parts of a $C_{14-15}$ linear primary alcohol (Neodol$^R$45, Shell Chemical). The mixture is heated to 100° C. and held at 100° C. for 2 hours followed by charging 42 parts ethylene glycol. The reaction mixture is heated to 180° C. over 8 hours; $H_{20}$ evolution begins at about 170° C. The reaction is continued at 180° C. for 4 hours. 7.6 ml of $H_2O$ is collected. The mixture is stripped to 180° C. at 15 Torr. The residue is filtered at 150° C. through cloth and a diatomaceous earth filter aid. The product has a number average molecular weight of 1130 as determined by gel permeation chromatography.

EXAMPLE 16

A 2-liter flask is charged with 921 parts glycerine and purged with $N_2$ at 2 cubic feet per hour flow rate while stirring. 10 parts NaOH powder is added and the mixture is heated to 255° C. The reaction is continued at 255°-260° C. for 1.5 hours while collecting water of evolution in a Dean-Stark water trap. A total of 132 parts $H_2O$ is collected. The product has a % OH=37.58 by analysis.

EXAMPLE 17

A 1-liter flask equipped with a stirrer, thermometer, Dean-Stark trap with condenser and $N_2$ sparge is charged with 236.5 parts of the product of Example 2 and 100 parts of the product of Example 16. The reaction is conducted at about 200° C. while removing $H_2O$. When $H_2O$ evolution essentially ceases, 202 parts of a 100 neutral oil is added, the materials are mixed thoroughly and filtered with a diatomaceous earth filter aid. The product has an acid number of about 2.5–3.0.

THE MINERAL OIL OF LUBRICATING VISCOSITY

The lubricating compositions and methods of this invention employ a mineral oil of lubricating viscosity. Mineral lubricating oils include those such as liquid petroleum oils and solvent-treated or acid-treated mineral lubricating oils of the paraffinic, naphthenic or mixed paraffinic-naphthenic types. Oils of lubricating viscosity derived from coal or shale are also useful.

Unrefined, refined and rerefined mineral oils, of the type disclosed hereinabove can be used in the compositions of the present invention. Unrefined oils are those obtained directly without further purification treatment. Refined oils are similar to the unrefined oils except they have been further treated in one or more purification steps to improve one or more properties. Rerefined oils are obtained by processes similar to those used to obtain refined oils, applied to refined oils which have been already used in service. Such rerefined oils are also known as reclaimed or reprocessed oils and often are additionally processed by techniques directed to removal of spent additives and oil breakdown products.

Specific examples of many of the above-described oils of lubricating viscosity are given in Chamberlin III, U.S. Pat. No. 4,326,972, which is hereby incorporated by reference for relevant disclosures contained therein. European Patent Publication No. 107,282 is also incorporated herein for the same purpose.

A basic, brief description of lubricant base oils appears in an article by D. V. Brock, "Lubrication Engineering", Volume 43, pages 184–5, March, 1987, which article is expressly incorporated by reference for relevant disclosures contained therein.

The polysuccinate esters are used in the mineral oil lubricating compositions of this invention at levels adequate to provide viscosity improving and/or fuel economy improving benefits. They are generally used in minor amounts in lubricating oil blends. They may be present at levels ranging from about 0.1 to about 35 percent by weight of the lubricating oil compositions, more often from about 1 to about 20 percent by weight. Preferably, they are present at about 2 to about 10 percent by weight.

Other Additives

The compositions of this invention may contain other components. The use of such additives is optional and the presence thereof in the compositions of this invention will depend on the particular use and level of performance required. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed hereinabove, other additives that may be used in the lubricating oils of this invention include, for example, detergents, dispersants, oxidation inhibiting agents, pour point depressing agents, extreme pressure agents, anti-wear agents, color stabilizers and anti-foam agents.

Extreme pressure agents and corrosion and oxidation inhibiting agents which may be included in the compositions of the invention are exemplified by chlorinated aliphatic hydrocarbons such as chlorinated wax and organic sulfides and polysulfides. Also contemplated are phosphorus esters.

Other viscosity improvers may be included in the lubricating oil compositions of this invention. Examples include polymethacrylic acid esters, diene polymers, polyalkyl styrenes, alkenylarene-conjugated diene copolymers and polyolefins. Multifunctional viscosity improvers which also have dispersant and/or antioxidancy properties are known. Such products are described in numerous publications including Dieter Klamann, "Lubricants and Related Products", Verlag Chemie Gmbh (1984), pp 185–193; C. V. Smalheer and R. K. Smith, "Lubricant Additives", Lezius-Hiles Co (1967); M. W. Ranney, "Lubricant Additives", Noyes Data Corp. (1973), pp 92–145; M. W. Ranney, "Lubricant Additives, Recent Developments", Noyes Data Corp (1978), pp 139–164; and M. W. Ranney, "Synthetic Oils and Additives for Lubricants", Noyes Data Corp. (1980), pp 96–166. Each of these publications is hereby expressly incorporated by reference.

Pour point depressants are a particularly useful type of additive often included in the lubricating oils described herein. The use of such pour point depressants and oil-based compositions to improve low temperature properties of oil-based compositions is well known in the art. See for example, page 8 of "Lubricant Additives" by C. V. Smallheer and R. Kennedy Smith (Lezius-Hiles Company Publishers, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents are used to reduce or prevent the formation of stable foam. Typical anti-foam agents include silicone or organic polymers. Additional anti-foam compositions are described in "Foam Control Agents", by Henry T. Kerner (Noyes Data Corporation, 1976), pages 125–162, which is expressly incorporated herein by reference.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a non-volatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent No. 1,306,529 and in many U.S. patents including the following which are expressly incorporated herein by reference.

| | | |
|---|---|---|
| 3,163,603 | 3,351,552 | 3,541,678 |
| 3,172,892 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |

(2) Reaction products of relatively high molecular weight aliphatic or alicyclic halides with amines, preferably polyalkylene polyamines. These may be characterized as "amine dispersnats" and examples thereof are described for example, in the following U.S. Pat. Nos.:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic, amine or Mannic dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubiolizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.:

| | |
|---|---|
| 3,329,658 | 3,666,730 |
| 3,449,250 | 3,687,849 |
| 3,519,565 | 3,702,300 |

The above-noted patents and publications are incorporated herein by reference for their disclosures of ashless dispersants.

The other members of above-illustrated optional additives may each be present in minor amounts in lubricating compositions at a concentration of as little as 0.001 percent by weight, usually ranging from about 0.01 percent to about 20 percent by weight. In most instances, they each may be present from about 0.1% to about 10% by weight.

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 0.1 to about 80% by weight of the compositions of this invention and may contain, in addition, one or more other additives known in the art or described hereinabove. Concentrations such as 15%, 20%, 30% or 50% or higher may be employed. These concentrates are then added to lubricating oils at levels adequate to provide the required degree of performance.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

As mentioned hereinabove, and in the claims, the lubricating oil is present in a major amount and the various additives are used in minor amounts. A minor amount is less than 50 percent by weight of the total composition, whereas a major amount is more than 50 percent by weight of the composition. Thus, for example, 5, 10, 30 or 40 percent are minor amounts, while 51, 60, 70, 90, etc. percent are major amounts.

The lubricating compositions of this invention are illustrated by the examples in the following Table I. The lubricating compositions are prepared by combining the specified ingredients, individually or from concentrates, in the indicated amounts and oil of lubricating viscosity to make the total 100 parts by weight. All parts and percentages are by weight of the total composition unless otherwise indicated. Unless indicated otherwise, the amount of each listed additive is that of the neat additive, free of oil or other diluent. These examples are presented for illustrative purposes only, and are not intended to limit the scope of this invention.

TABLE I

A series of SAE 5W-30 lubricating oil compositions are prepared by making up a master blend comprising a mineral oil of lubricating viscosity (Sun Oil Co. stocks), 2.56 percent styrene-alkyl maleate copolymer, 1.96 percent of a reaction product of ethylene polyamines with polyisobutenyl succinic anhydride, 0.95 percent of overbased metal sulfonates, 1.60 percent of zinc dialkyl phosphorodithioates and 5 ppm of a silicone antifoam, and adding thereto the indicated amounts of the following components to prepare 100 parts by weight of blend:

| Example | Component-Product of Example: | Parts by weight |
|---|---|---|
| A | 3 | 1 |
| B | 4 | 1 |
| C | 15 | 1 |
| D | 14 | 3.3 |

TABLE II

Two blends (SAE 10W-30) are prepared, each blend comprising mineral oil (Exxon stocks), 0.53 percent of styrene-isoprene copolymer, 0.12 percent styrene-alkyl maleate copolymer, 1.72 parts of a reaction product of ethylene polyamine with polyisobutenyl succinic anhydride, 0.10 percent of fatty acid amide, 1.03 percent of zinc dialkyl phosphorodithioates, 0.20 percent of a sulfurized Diels-Alder adduct, 0.09 percent alkylated diphenyl amine, 0.87 percent of overbased metal sulfonates, 6 ppm of a silicone antifoam and the indicated amount of polyester:

| Example | Component-Product of Example: | Parts by weight per 100 parts blend |
|---|---|---|
| E | 3 | 0.50 |
| F | 3 | 0.85 |

TABLE III

Engine Lubricating Oil Compositions

| Component | Parts by Weight | |
|---|---|---|
| | Example G | Example H |
| Oil | Exxon 10W-30* | Sun 10W-30* |
| Styrene-isoprene copolymer | 0.53 | |
| Reaction product:ethylene polyamine and polyisobutenyl succinic anhydride | 1.72 | 1.13 |
| Styrene-alkyl maleate copolymer | 0.12 | |
| Reaction product:ethylene polyamine-polyol-polyisobutenyl succinic anhydride | | 1.38 |
| Zinc dialkyl phosphorodithioates | 1.03 | 1.16 |
| Overbased metal sulfonates | | 1.08 |
| Sulfurized Diels-Alder Adduct | 0.20 | 0.20 |
| Alkylated diphenyl amine | 0.09 | |
| Silicone antifoam | 6 ppm | |
| Sulfurized alkyl phenol | | 0.69 |
| Ethylene-propylene copolymer, diene modified | | 0.75 |
| Polymer of alkylated unsaturated dicarboxylic acid vinyl carboxylate and vinyl alkyl ether | | 0.14 |
| Product of Example 3 | 0.50 | |
| Product of Example 5 | | 1.0 |

*Mineral oil of lubricating viscosity in amount sufficient to bring total blend to 100 parts by weight.

The fuel consumption of internal combustion engines is reduced when the engines are lubricated with the compositions of this invention. This can be shown by the Friction Horsepower Test, in which an engine is driven by a motoring-absorbing dynamometer at controlled temperatures while engine r.p.m. and torque are measured by a digital tachometer and a precision dial manometer, respectively. Friction horsepower, as calculated from these values, is roughly proportional to fuel consumed in an operating engine. Lubricants which reduce friction horsepower levels in test engines can increase vehicle fuel economy.

Lubricating oil compositions E, F and G are evaluated using the above-described Friction Horsepower Test employing 3.8 liter Buick V-6 engines. These compositions show improvements over baselines of 8%, 10.2% and 13%, respectively.

Baseline lubricating compositions are essentially the same as Examples E, F and G except that they do not contain the additives of this invention.

The instant invention is shown and described herein in what is considered to be the most practical, and the preferred embodiments. It is recognized, however, that departures may be made therefrom which are within the scope of the invention, and that obvious modifications will occur to one skilled in the art upon reading this disclosure.

What is claimed is:

1. A lubricating composition comprising a major amount of a mineral oil of lubricating viscosity and a minor amount of at least one polysuccinate ester having a molecular weight between about 1000 and about 4000, and which is essentially free of cycloaliphatic groups, and wherein succinic groups of the polysuccinate ester contain alkyl or alkenyl substituents having from about 4 to about 28 carbon atoms.

2. The composition according to claim 1 wherein the substituents contain about 12 to about 24 carbon atoms.

3. The composition according to claim 1 wherein the succinate esters are glycol esters, glycerol esters, pentaerythritol esters, or neo-diol esters.

4. The composition according to claim 1 wherein the polyester has an acid number as determined by ASTM D-974 of from 0 to about 60.

5. The composition according to claim 1 wherein the polysuccinate ester contains terminal carboxylic acid groups.

6. The composition according to claim 5 wherein at least 50% of the terminal carboxylic acid groups are converted to amido groups, ester groups, salts, or mixtures thereof.

7. The composition according to claim 2 wherein the polyester has a molecular weight between about 2000 and about 4000 and an acid number as determined by ASTM D-974 between about 10 to about 20.

8. A lubricating composition comprising a major amount of a mineral oil of lubricating viscosity and a minor amount of a polyester having a molecular weight between about 1000 and about 4000, prepared by the condensation reaction of (A) at least one alkyl or alkenyl substituted succinic acid or anhydride, wherein the alkyl or alkenyl substituent contains from about 4 to about 28 carbon atoms, with (B) at least one open-chain aliphatic compound having at least two OH groups, wherein the ratio of reactant A to reactant B is from about one succinic group:1.8 OH groups to about 1 succinic group:4 OH groups.

9. The composition according to claim 8 wherein the substituent contains from about 12 to about 24 carbon atoms.

10. The composition according to claim 8 wherein the substituent on (A) is a substantially linear group.

11. The composition according to claim 8 wherein (B) contains an average of from 2 to about 4 OH groups.

12. The composition according to claim 11 wherein (B) is at least one of ethylene glycol, neopentylene glycol, glycerol, and pentaerythritol or mixtures thereof.

13. The composition according to claim 11 wherein (B) is a fatty acid monoester of glycerol or a dihydroxypolyalkoxyalkane.

14. The composition according to claim 9 wherein (A) is a succinic anhydride.

15. The composition according to claim 8 wherein the ratio of reactant (A) to reactant (B) is from about 1 succinic group:2 OH groups to about 1 succinic group:2.4 OH groups.

16. The composition according to claim 8 wherein the polyester has a molecular weight of about 1400 to about 4000.

17. The composition according to claim 16 wherein the polyester has a molecular weight from about 2000 to about 3000.

18. The composition according to claim 8 wherein the polyester has an acid number as determined by ASTM D-974 of 0 to about 60.

19. The composition according to claim 8 wherein the polyester is capped by reacting terminal carboxylic acid groups with a monohydric alcohol, an isocyanate, a diol, a metal-containing reagent, or an amine.

20. The composition according to claim 14 wherein (B) is ethylene glycol and the ratio of reactant (A) to reactant (B) is from about 1 succinic group:2 OH groups to about 1 succinic group:2.4 OH groups.

21. The composition according to claim 20 wherein the polyester has a molecular weight between about 2000 and about 4000 and an acid number as determined by ASTM D-974 of from about 10 to about 20.

22. A lubricating composition comprising a major amount of a mineral oil of lubricating viscosity and a minor amount of at least one polysuccinate ester having a molecular weight between about 1000 and about 4000, prepared by the condensation reaction of (A) at least one alkyl or alkenyl substituted succinic acid or anhydride, wherein the alkyl group contains from about 4 to about 28 carbon atoms, with (C) at least one epoxide.

23. The composition according to claim 22 wherein the epoxide (C) is an alpha-olefin epoxide containing from 2 to about 24 carbon atoms.

24. The composition according to claim 22 wherein the molar ratio of (A):(C) in the reaction mixture is between about 0.8:1.2 and about 1.2:0.8.

25. The composition according to claim 22 wherein the substituent contains from about 12 to about 24 carbon atoms.

26. The composition according to claim 23 wherein the epoxide (C) contains from about 8 to about 18 carbon atoms.

27. The composition according to claim 22 wherein at least 50% of terminal carboxylic acid groups present in the polyester are converted to amido groups, ester groups, salts or mixtures thereof.

28. A polysuccinate ester of the formula $$A—S—E—(S—E)_n—S—B \quad (II)$$

wherein n is a number between 1 and about 8, each S is a group of the formula

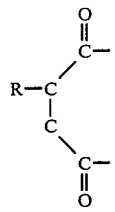

(III)

wherein

R is an alkyl or alkenyl group having from 4 to about 28 carbon atoms, and each E is a group of the formula $$—O(R'O)_a \quad (IV)$$

wherein

R′ is selected from the group consisting of alkylene groups having from 2 to about 28 carbon atoms, hydroxy substituted alkylene groups having from 2 to about 28 carbons, and containing from one to about 6 hydroxy groups, with the proviso that the number of hydroxy groups does not exceed the unsatisfied valences of R′, and succinate ester substituted alkylene groups, and wherein a is a number ranging from 1 to about 8, wherein each A and each B is independently

—OH,

—$OR^2$, wherein $R^2$ is an alkyl group containing from 1 to about 28 carbons, —$O(R'O)_bH$, wherein R′ is an alkylene group containing from about 2 to about 28 carbon atoms, and b is a number ranging from 1 to about 8, and —$NR_2^3$, wherein each $R^3$ is independently H or an alkyl group having from 1 to about 18 carbon atoms, with the proviso that at least one of A or B is not —OH, or, when A or B is —OH, a salt may be formed by reaction with a basic metal containing reagent, ammonia or an amine, and which polysuccinate ester has a molecular weight between about 1000 and about 4000.

29. The ester of claim 28 wherein R contains from about 12 to about 20 carbon atoms, and n is a number between about 1 and 4.

30. The composition according to claim 29 wherein each R′ is independently alkylene of from 2 to about 16 carbon atoms or hydroxy substituted alkylene having from 1 to 3 hydroxy groups.

31. A lubricating composition comprising a major amount of a mineral oil of lubricating viscosity and a minor amount of a polysuccinate ester according to claim 28.

32. The composition according to claim 1 wherein the composition comprises from about 0.10% to about 35% by weight of the polyester.

33. The composition according to claim-8 wherein the composition comprises from about 0.10% to about 35% by weight of the polyester.

34. The composition according to claim 22 wherein the composition comprises from about 0.10% to about 35% by weight of the polyester.

35. A lubricating composition comprising a mineral oil of lubricating viscosity and from about 0.10% to about 35% by weight of the polyester of claim 28.

36. A method for reducing the internal friction of an internal combustion engine which comprises lubricating the internal parts of said engine with the lubricating composition of claim 2.

37. A method for reducing the internal friction of an internal combustion engine which comprises lubricating the internal parts of said engine with the lubricating composition of claim 9.

38. A method for reducing the internal friction of an internal combustion engine which comprises lubricating the internal parts of said engine with the lubricating composition of claim 25.

39. A method for reducing the internal friction of an internal combustion engine which comprises lubricating the internal parts of said engine with the lubricating composition of claim 31.

* * * * *